US007048250B2

(12) United States Patent
Mothes

(10) Patent No.: US 7,048,250 B2
(45) Date of Patent: May 23, 2006

(54) METHOD FOR PRODUCING PURPOSE-MADE BLOCKS, A DEVICE THEREFOR AND A PURPOSE-MADE BLOCK

(75) Inventor: Steffen Mothes, Weimar (DE)

(73) Assignee: Franz Carl Nudling Basaltwerke GmbH & Co. KG (DE)

( * ) Notice: Subject to any disclaimer, the term of this patent is extended or adjusted under 35 U.S.C. 154(b) by 407 days.

(21) Appl. No.: 10/204,385

(22) PCT Filed: Dec. 20, 2001

(86) PCT No.: PCT/EP01/15097

§ 371 (c)(1),
(2), (4) Date: Feb. 6, 2003

(87) PCT Pub. No.: WO02/051603

PCT Pub. Date: Jul. 4, 2002

(65) Prior Publication Data

US 2003/0140574 A1 Jul. 31, 2003

(30) Foreign Application Priority Data

Dec. 23, 2000 (DE) ..... 100 65 886
Feb. 17, 2001 (DE) ..... 101 07 531

(51) Int. Cl.
*B28B 7/16* (2006.01)
*B41B 11/54* (2006.01)

(52) U.S. Cl. ..... 249/52; 249/101; 249/160; 405/286; 52/596; 52/605; 425/304; 425/436 R

(58) Field of Classification Search ..... 405/262, 405/284, 286; 249/52, 98, 140, 160, 161, 249/101–104, 170–172, 176, 179; 425/304, 425/436 R, 436 RM, 442, 443, 410; 52/100, 52/596, 604–609

See application file for complete search history.

(56) References Cited

U.S. PATENT DOCUMENTS 2,567,549 A * 9/1951 Christensen ..... 425/443

(Continued)

FOREIGN PATENT DOCUMENTS

| | | |
|---|---|---|
| DE | 26 08 871 A | 9/1977 |
| DE | 44 09 271 A | 9/1995 |
| EP | 0 316 653 A | 5/1989 |

(Continued)

*Primary Examiner*—Jong-Suk (James) Lee
(74) *Attorney, Agent, or Firm*—Powell Goldstein LLP; Laurence P. Colton

(57) ABSTRACT

A method for producing purpose-made blocks (10). According to said method, several purpose-made blocks (10) are produced in a mold (37) in such a way that the blocks (10) are arranged in at least one row (28) of purpose-made blocks in the mold (37) and respective adjacent blocks (10) of a block row (28) are interconnected in a zone of at least one predetermined breaking point (30). The purpose-made blocks (10) of a block row (28) are removed together from the mold (37) and the blocks (10) are separated from one another in the zone of the predetermined breaking point (30). According to the invention, adjacent purpose-made blocks (10) of one or each block row (28) are produced in the mold (37) in such a way that axes of the purpose-made blocks (10) deviate at least partially in the longitudinal direction (32) of each block row (28) from the longitudinal axis (32) of each block row (28) and that lateral pressure is exerted on the or each molded block row (28) to separate the predetermined breaking points (30). The invention also relates to a corresponding mold (37) and to a purpose-made block row that is produced in said mold (37).

43 Claims, 4 Drawing Sheets

U.S. PATENT DOCUMENTS 2,582,161 A * 1/1952 Randall ..... 249/101
4,860,505 A * 8/1989 Bender ..... 405/286
5,205,943 A * 4/1993 Jazzar ..... 249/27

FOREIGN PATENT DOCUMENTS

JP 05000399 * 1/1993 ..... 425/436 R

* cited by examiner

METHOD FOR PRODUCING PURPOSE-MADE BLOCKS, A DEVICE THEREFOR AND A PURPOSE-MADE BLOCK

CROSS REFERENCE TO RELATED APPLICATION

This application is a national stage of PCT/EP01/15097 filed Dec. 20, 2001 and based upon Germany 100 65 886.5 filed Dec. 23, 2000 and Germany 101 07 531.6 filed Feb. 17, 2001 under the international convention.

BACKGROUND OF THE INVENTION

1. Technical Field

The invention relates to a method of producing molded blocks in which a plurality of molded blocks are produced in a mold in such a way that the molded blocks are arranged in the mold in at least one molded block row and respective adjacent molded blocks of a molded block row are interconnected in the region of at least one predetermined breaking point, the molded blocks of a molded block row preferably being removed from the mold as a continuous unit and being separated from one another in the region of the predetermined breaking points. Furthermore, the invention relates to a device, in particular a mold for the production of molded blocks comprising a mold frame, which rests on a support board and which has, at the bottom and top, open mold cavities which are delimited by mold walls of the mold frame, a plurality of mold cavities being arranged in at least one row, and also to a row of molded blocks, in particular comprising at least four upright side walls and substantially horizontally oriented top surface and bottom surface, the molded block row being formed from a plurality of molded blocks and adjacent molded blocks of a molded block row being connected to one another in the region of predetermined breaking points.

2. Prior Art

The invention relates, in particular, to the production of what are known as plantable wall blocks. This involves producing a plurality of molded blocks as a continuous unit in a mold and, following mold removal, separating them from one another in the region of predetermined breaking points. The molded blocks are generally separated by hand using suitable tools. In the region of the predetermined breaking points, side faces of the molded blocks have a fracture plane which forms an exposed face after the molded blocks have been laid. A disadvantage of known methods is the high expenditure on time and energy required to separate the molded blocks.

BRIEF SUMMARY OF THE INVENTION

Taking this as a starting point, the invention is based on the object of proposing measures, such as a method, a mold and a molded block row, by means of which it is possible in a simple and reliable manner to form molded blocks by dividing the molded block row.

To achieve this object, the method according to the invention comprises a method of producing molded blocks, in which a plurality of molded blocks are produced in a mold in such a way that the molded blocks are arranged in the mold in at least one molded block row and respective adjacent molded blocks of a molded block row are interconnected in the region of at least one predetermined breaking point, the molded blocks of a molded block row preferably being removed from the mold as a continuous unit and being separated from one another in the region of the predetermined breaking points, characterized in that adjacent molded blocks of one or of each molded block row are produced in the mold in such a way that axes of the molded blocks deviate at least partially from the longitudinal axis of the respective molded block row in the longitudinal direction of the respective molded block row, and in that, in order to sever the predetermined breaking points, lateral pressure is exerted on each molded block row. These measures make it possible in a surprisingly simple manner to separate the individual molded blocks of a molded block row from one another. By virtue of the lateral pressure, the molded block row is exposed to corresponding forces which lead to the rupture of the molded block row in the region of the predetermined breaking points and thus to the separation of the molded blocks. In a preferred embodiment of the method according to the invention, the axes and, in particular, the side faces of the molded blocks have directions which deviate from one another in the longitudinal direction of the respective molded block row, in particular such that they have an approximately zigzag-shaped course. For example, the longitudinal axes of adjacent molded blocks can run obliquely or at an angle to one another. This means that by applying comparatively little pressure, the molded block row is exposed to tensile forces which lead to the separation of the molded blocks from one another, specifically in the region of the predetermined breaking points. It is also conceivable that within a molded block row some molded blocks have axes which are parallel to one another and some molded blocks have obliquely oriented axes.

According to a development of the method according to the invention, a plurality of molded block rows are arranged in such a way, in order to sever the predetermined breaking points, that the molded block rows lie against one another only in certain regions, in particular in the region of predetermined breaking points, and that the respective outer molded block rows are moved toward one another. By means of the lateral pressure on the molded block rows, the latter are pressed against one another. It is preferable for this purpose for the respective outer molded block rows to be moved toward one another.

Also serving to achieve the object set at the beginning is a device, in particular mold, for the production of molded blocks, comprising a mold frame, which rests on a support board and which has, at the bottom and top, open mold cavities which are delimited by mold walls of the mold frame, a plurality of mold cavities being arranged in at least one row, characterized in that adjacent mold cavities of a row are connected to one another, such that the molded blocks of a row which can be produced in the mold are interconnected to form a molded block row, and in that the mold cavities are arranged in such a way that axes and, in particular, side faces run in an at least partially deviating manner from a longitudinal axis of the respective molded block row in the longitudinal direction of the respective molded block row. This device is preferably suited for use in the method according to the invention. After they have been fabricated by the method according to the invention, the molded blocks or molded block rows produced in this device can be separated from one another in a simple and reliable manner, particularly using a machine.

A molded block row serving to achieve the object comprises at least four upright side walls and substantially horizontally oriented top surface and bottom surface, the molded block row being formed from a plurality of molded blocks and adjacent molded blocks of a molded block row being connected to one another in the region of predetermined breaking points, characterized in that axes and, in particular, side faces of at least some adjacent molded blocks deviate at least partially from a longitudinal axis of the respective molded block row in the longitudinal direction of the respective molded block. In the above-described method according to the invention, such molded block rows can be divided in a particularly simple manner to form individual molded blocks. Each molded block row preferably has at least two molded blocks.

According to a further development of the invention, molded blocks of shorter length, in particular end blocks, are arranged at at least one free end of a molded block row. The end blocks, too, are connected to an adjacent molded block in the region of a predetermined breaking point, with the result that when the molded block row is divided, each molded block (with the exception of the end blocks) has two exposed faces with a broken structure.

BRIEF DESCRIPTION OF THE DRAWINGS

Further details of the invention are explained in more detail below with reference to a preferred exemplary embodiment of the invention illustrated in the drawing, in which.

DETAILED DESCRIPTION OF THE PREFERRED EMBODIMENTS

Figure 1:
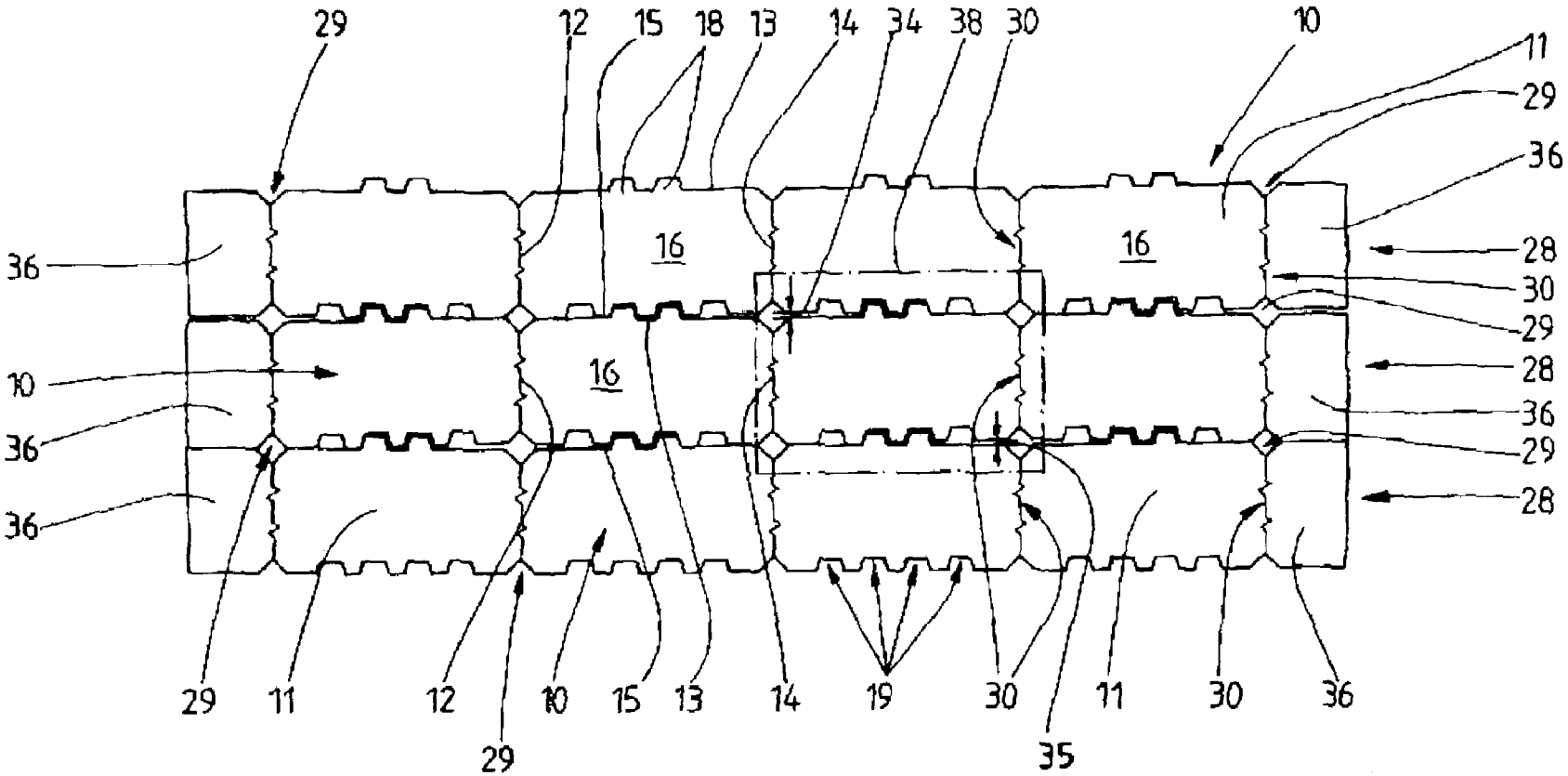
FIG. 1 shows a plan view of a plurality of molded block rows according to the present invention.

The exemplary embodiment illustrated in FIGS. 1 to 4 relates to the production of what are known as plantable wall blocks. Such blocks are used, for example, for the construction of partially plant-bedecked retaining walls or the like. Since the blocks are not exclusively restricted to being used in conjunction with plantable walls, the general term molded block 10 is used hereinafter to represent other types of blocks.

In the present exemplary embodiment, the molded block 10 shown is composed of a basic body 11 of substantially rectangular outline having upright side faces 12, 13, 14, 15 and horizontally oriented top surface 16 and bottom surface 17. Two projections 18 of trapezoidal outline are arranged in the region of the side face 13. The opposite side face 15 has four corresponding recesses 19 likewise of trapezoidal outline. Within a laid soil cover or retaining wall, the projections 18 and recesses 19 serve for the horizontal and/or vertical interlocking of the molded blocks 10. In this arrangement, the projections 18 of a molded block 10 mate with recesses 19 of an adjacent molded block 10.

Figure 4:
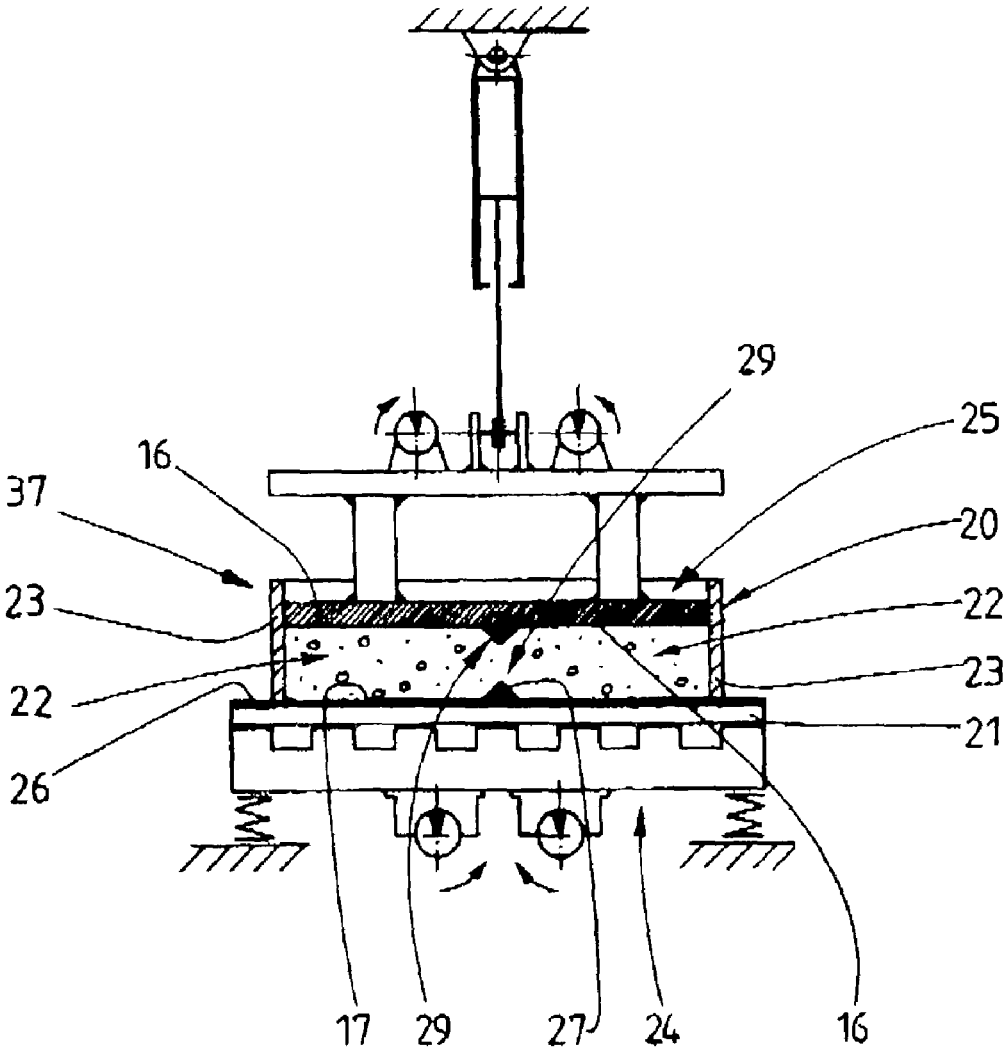
FIG. 4 shows a schematic illustration of a device for fabricating molded blocks, in vertical section, according to the present invention.

The molded blocks 10 are produced in a device having substantially known parts according to FIG. 4. Here, a mold frame 20, open at the top and bottom, of a mold 37 rests on a support board 21. The mold frame 20 has a plurality of mold cavities 22 which are delimited by upright mold walls 23 of the mold frame 20. Concrete is introduced into the mold cavities 22 from above and compacted by means of vibratory action. As in the exemplary embodiment shown, the support board 21 can rest on a vibrating table 24 for this purpose. To delimit the top surface 16 of the molded blocks 10, a ram 25 is lowered into the mold cavities 22 from above. A bottom surface of the ram 25 is additionally profiled in order to create constrictions 29 in the region of the top surface 16 of the molded blocks 10. In order to create constrictions 29 in the region of the bottom surface 17 of the molded blocks 10, a drawing plate 26 is arranged between the mold frame 20 and the support board 21. The drawing plate 26 features upwardly protruding webs 27 on its top surface. In order to create the constrictions 29, the drawing plate is drawn away laterally under the mold frame 20, with the webs 27 forming the constrictions 29.

A particular feature of the device shown in FIG. 4 consists in the arrangement of the mold cavities 22 in the mold frame 20. The mold cavities 22 are arranged in a row in the mold frame 20. In this arrangement, adjacent mold cavities 22 are in each case connected to one another in the region of the side faces 12, 14, so that a plurality of molded blocks 10 of one row in each case are fabricated as a continuous unit to form a molded block row 28. FIG. 1 shows the outline of three molded block rows lying next to one another and fabricated in such a mold. The mold cavities 22 are also designed in such a way that the molded block rows 28 have constrictions 29 at the transition from the side faces 13, 15 to the side faces 12, 14 of adjacent molded blocks 10. Further constrictions 29 are arranged between the top surfaces 16 and bottom surfaces 17 of adjacent molded blocks 10. As a result of the constrictions 29, the cross-sectional area of the molded block row 28 is reduced, and, consequently, predetermined breaking points 30 are formed between the adjacent molded blocks 10 of a molded block row 28. The predetermined breaking points 30 in each case run between two constrictions 29 which are situated opposite one another on the side faces 13, 15 or the top surface 16 and bottom surface 17. The constriction 29 between the top surfaces 16 and bottom surfaces 17 of adjacent molded blocks 10 are formed on the one hand by appropriate profiling of the ram 25 and on the other hand by the webs 27 on the drawing plate 26 (FIG. 4). As shown, the constrictions 29 here can have a triangular or notch-like cross section. Accordingly, it is preferred for the constrictions 29 to be arranged such that they run around the cross-sectional area of the molded blocks.

Figure 3:
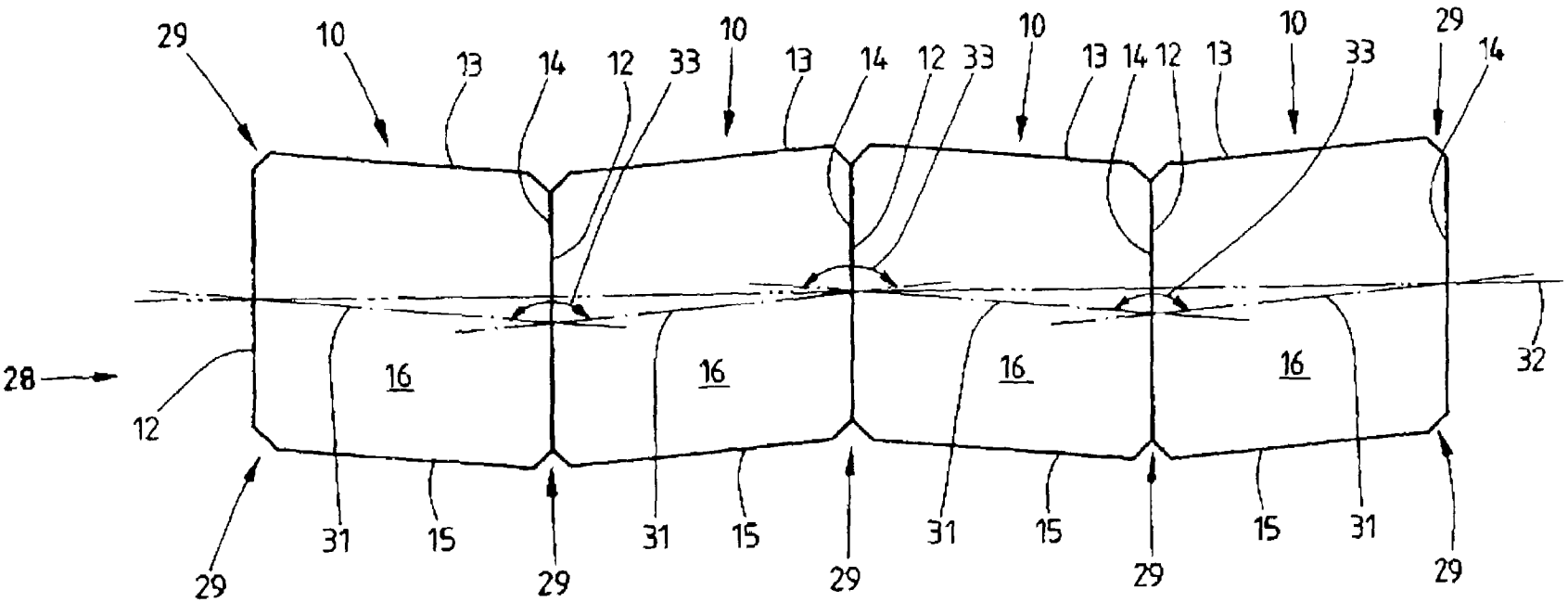
FIG. 3 shows a schematic illustration of a molded block row on an enlarged scale according to the present invention.

An important particular feature of the invention consists in the fact that the mold cavities 22 or the molded blocks 10 of a molded block row 28 are arranged in different relative positions with respect to one another. Each molded block 10 has an imaginary axis 31 in the longitudinal direction of the molded block row 28. In horizontal projection, the axis 31 runs parallel to the opposite side faces 13, 15 in the center of the molded blocks 10. In the case of antiparallel side faces 13, 15, the axis 31, seen in horizontal projection, runs as a bisector between the two side faces 13, 15. The mold cavities 22 or the molded blocks 10 of a molded block row 28 are aligned in such a way that their axis 31 runs in a deviating manner with respect to the longitudinal direction of the molded block row 28. For the purpose of clarification, FIG. 3 is a schematic representation of part of a molded block row 28 on an enlarged scale. The axes 31 of the molded blocks 10, and correspondingly the side faces 13, 15, here run obliquely with respect to the longitudinal direction of the molded block row 28, which is indicated by the longitudinal axis 32. As a result, the side faces 13, 15 of the molded blocks 10 of a molded block row 28 have a non-uniform course in the longitudinal direction of the molded block row 28. The angle 33 between the axes 31 of adjacent molded blocks 10 can be, for example, between 179° and 140°, in particular between 179° and 170°. In the exemplary embodiment shown, the angle 33 is approximately 177°. The axes 31 of adjacent molded blocks 10 within a molded block row 28 run antiparallel in this case. The axis 31 of every second molded block 10 of a molded block row runs at the same angle 33 in the same direction, with the result that the molded block row 28 has an approximately zigzag-shaped course or contour in the region of the side faces 13, 15 of the molded blocks 10. In this case, the molded blocks 10 are not exactly rectangular in outline, but instead are approximately parallelogram-shaped.

Figure 2:
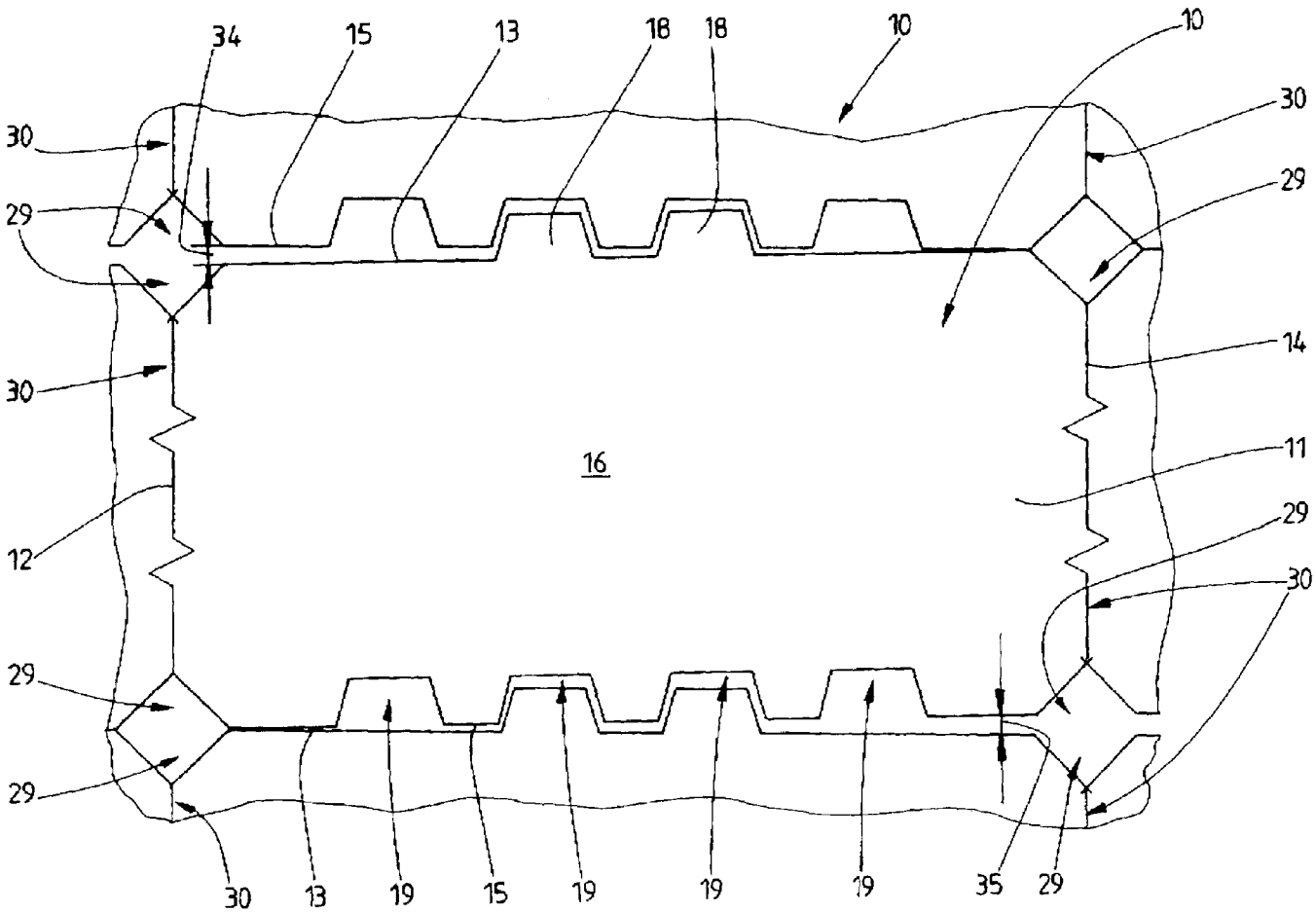
FIG. 2 shows an enlarged illustration of a subregion of FIG. 1.

A plurality of molded block rows 28 are preferably fabricated in a mold frame 20 in one operation. The arrangement of the mold cavities 22 of a molded block row 28 deviates here from the arrangement of the mold cavities 22 of an adjacent molded block row 28, with the result that, in the region of the side faces 13, 15, the molded block rows have an at least partially deviating course from one another in the longitudinal direction thereof. FIG. 2 shows an extract 38 according to FIG. 1 of three molded block rows 28 lying next to one another and having a course deviating from one another. In this case, the side faces 13 of one molded block 10 run at an angle 34 of, for example, 1.4° to adjacent side faces 15 of a further molded block 10, with the result that these side faces 13, 15 have a maximum spacing 35 of 5.5 mm. As can be seen in FIG. 1, the molded block rows 28 are designed and arranged in such a way that they have in each case an oppositely directed course with respect to the adjacent molded block row 28. After the concrete has been introduced into the mold cavities 22 and compacted, the mold frame 20 is immediately withdrawn upward from the molded block rows 28, with the result that the latter lie freely on the support board 21, as shown in FIG. 1 and FIG. 3. Alternatively, the mold frame 20 can also be withdrawn after at least partial setting of the concrete.

Following possible further setting of the concrete, the molded block rows 28 are removed from the support board 21. A particular feature here consists in the fact that the molded block rows 28 are gripped, for example by mechanical gripping members, along the outer side faces 13, 15 of the outer molded block rows 28. During the gripping operation, the molded block rows 28 are pressed against one another laterally, transversely with respect to the longitudinal direction of the molded block rows 28, the latter lying only partially against one another as a result of the different course in the longitudinal direction. In this respect, the molded block rows 28 are designed in such a way that they lie against and among one another only in the region of some predetermined breaking points 30, in particular in the region of every second predetermined breaking point 30, as in the exemplary embodiment shown. During the gripping operation, the molded block rows 28 are consequently stressed in flexure transversely with respect to the longitudinal direction of said rows. With correspondingly high lateral pressure, the molded block rows 29 rupture in the region of the predetermined breaking points 28, with the result that the molded blocks 10 of the molded block rows 28 are separated from one another. A broken surface which roughly resembles a natural stone thus results in the region of the side faces 12, 14 of the molded blocks 10. During the subsequent laying operation, the molded blocks 10 can be arranged in such a way that the side faces 12, 14 are positioned in the region of an exposed face of, for example, a wall or soil cover.

The number of molded blocks 10 which can be produced in a mold frame 20 in one operation is essentially limited only by the dimensions of known devices for producing molded blocks 10. In the exemplary embodiment shown, the length of a molded block row 28 is about 1.10 m. In this case, a molded block row 28 in each case comprises four molded blocks 10 plus two end blocks 36. The end blocks 36 are in each case arranged at a free end of the molded block row 28 and have a shorter length than the molded blocks 10, for example 80 mm. By virtue of the arrangement of the end blocks 36, the two outer molded blocks 10 of a molded block row 28 also have a broken surface in the region of both side faces 12, 14 after separation has taken place. If the formation of the broken surface is unimportant, it is also possible to dispense with the end blocks 36. As an alternative, it is also possible for a molded block row 28 to be composed of only two molded blocks 10, in which case the end blocks 36 are also dispensed with, with the result that two molded blocks 10 each having a single broken exposed face can be obtained from a molded block row 28.

As already mentioned above, it is possible to produce a plurality of molded block rows 28 in a mold frame 20 in one operation, with the molded block rows 28 having, in the region of the side faces 13, 15, a mutually deviating course in the longitudinal direction thereof, with the result that they lie against one another only in certain regions during the severing of the predetermined breaking points 30. As described above, the molded blocks 10 can be separated directly after mold removal. However, to separate the molded blocks 10, it is also possible, after mold removal, to lay a plurality of molded block rows 28 next to one another, for example at the processing location, i.e. the building site. It is conceivable here to use mold frames 20 of different design so that the molded block rows 28 have a mutually deviating course. However, it is preferable to operate in such a way that the molded block rows 28 are fabricated in identical mold frames 20 and that, for the purpose of separation, the molded block rows 28 are laid next to one another with, in alternation, the top surface 16 and the bottom surface 17 facing upward, or that the molded block rows 28 are arranged with their relative positions rotated in each case through 180° to one another. It is also conceivable that the molded block rows 28 are in each case laid next to one another with the top surface 16 facing upward, in which case, however, the molded block rows 28 are arranged laterally offset with respect to one another. This ensures that, for the purpose of separating the predetermined breaking points 30 between the molded blocks 10, the molded block rows 28 lie against one another only in certain regions in the region of the side faces 13, 15.

Alternatively, it is also conceivable that the axes 31 of the molded blocks 10 run parallel to the longitudinal axis 32 and with a spacing from the latter. In this arrangement, the axes 31 of adjacent molded blocks 10 of the respective molded block row 28 in each case have another spacing from the longitudinal axis 32, preferably lying on another side of the longitudinal axis 32. It is also conceivable that axes 31 of some molded blocks 10 of a molded block row 28 are aligned parallel to the longitudinal axis 32 and some axes 31 of other molded blocks 10 of a molded block row 28 run obliquely with respect to the longitudinal axis 32.

Alternatively, it is also possible, for example, for only one molded block row 28 to be produced in a mold frame 20. In this case, the molded blocks 10 of this molded block row 28 are separated by means of pressure on opposite sides of the individual molded block row 28. This can also take place in situ on the building site.

As mentioned at the outset, the above-described method of producing molded blocks 10 is not restricted to being used in conjunction with the production of plantable wall blocks. In principle, it is possible in this way to produce molded blocks 10 for any other intended use. The same applies to the above-described device or mold 37. The described arrangement and alignment of the mold cavities 22 can also be used independently of the outline shape of the molded blocks 10.

LIST OF REFERENCE NUMERALS

10. Molded block
11. Basic body
12. Side face
13. Side face
14. Side face
15. Side face
16. Top surface
17. Bottom surface
18. Projection
19. Recess
20. Mold frame
21. Support board
22. Mold cavity
23. Mold wall
24. Vibrating table
25. Ram
26. Drawing plate
27. Web
28. Molded block row
29. Constriction
30. Predetermined breaking point
31. Axis
32. Longitudinal axis
33. Angle
34. Angle
35. Spacing
36. End block
37. Mold
38. Extract

The invention claimed is:

1. A method of producing molded blocks (10), in which a plurality of molded blocks (10) are produced in a mold (37) in such a way that the molded blocks (10) are arranged in the mold (37) in at least one molded block row (28) and respective adjacent molded blocks (10) of a molded block row (28) are interconnected in the region of at least one predetermined breaking point (30), the molded blocks (10) of a molded block row (28) being removed from the mold (37) as a continuous unit and being separated from one another in the region of the predetermined breaking points (30), characterized in that adjacent molded blocks (10) of at least one molded block row (28) are produced in the mold (37) in such a way that axes of the molded blocks (10) deviate at least partially from a longitudinal axis (32) of the respective molded block row (28) in the longitudinal direction of the respective molded block row (28), and in that, in order to sever the predetermined breaking points (30), lateral pressure is exerted on each molded block row (28).

2. The method as claimed in claim 1, characterized in that the axes (31) and side walls (13, 15) of at least some molded blocks (10) have directions which deviate from one another in the longitudinal direction of the respective molded block row (28) such that they have an approximately zigzag-shaped course.

3. The method as claimed in claim 2, characterized in that, in order to sever the predetermined breaking points (30) between the molded blocks (10) of the molded block rows (28), a plurality of molded block rows (28) are arranged next to one another in such a way that the molded block rows (28) lie against one another only in certain regions and in that the respective outer molded block rows (28) are moved toward one another.

4. The method as claimed in claim 3, characterized in that the molded block rows (28) are pressed against one another transversely with respect to the longitudinal extent of said rows.

5. The method as claimed in claim 4, characterized in that the molded block rows (28) are arranged approximately parallel in such a way that they lie against one another in the region of at least some predetermined breaking points (30).

6. The method as claimed in claim 5, characterized in that a plurality of molded block rows (28) are produced in a mold (37), the molded block rows (28) resting on a support board (21) after the at least partial setting of said rows and being pressed laterally against one another on removal from the support board (21).

7. The method as claimed in claim 4, characterized in that a plurality of molded block rows (28) are produced in a mold (37), the molded block rows (28) resting on a support board (21) after the at least partial setting of said rows and being pressed laterally against one another on removal from the support board (21).

8. The method as claimed in claim 3, characterized in that the molded block rows (28) are arranged approximately parallel in such a way that they lie against one another in the region of at least some predetermined breaking points (30).

9. The method as claimed in claim 3 characterized in that a plurality of molded block rows (28) are produced in a mold (37), the molded block rows (28) resting on a support board (21) after the at least partial setting of said rows and being pressed laterally against one another on removal from the support board (21).

10. The method as claimed in claim 3, characterized in that the molded block rows (28) are arranged approximately parallel in such a way that they lie against one another in the region of every second predetermined breaking point.

11. The method as claimed in claim 2, characterized in that a plurality of molded block rows (28) are produced in a mold (37), the molded block rows (28) resting on a support board (21) after the at least partial setting of said rows and being pressed laterally against one another on removal from the support board (21).

12. The method as claimed in claim 2, characterized in that an individual molded block row (28) is removed from the mold (37) and the predetermined breaking points (30) between the molded blocks (10) of the molded block row (28) are severed by means of lateral pressure on the side faces (13, 15) of the molded blocks (10).

13. The method as claimed in claim 1, characterized in that an individual molded block row (28) is removed from the mold (37) and the predetermined breaking points (30) between the molded blocks (10) of the molded block row (28) are severed by means of lateral pressure on the side faces (13, 15) of the molded blocks (10).

14. The method as claimed in claim 1, characterized in that, in order to sever the predetermined breaking points (30) between the molded blocks (10) of the molded block rows (28), a plurality of molded block rows (28) are arranged next to one another in such a way that the molded block rows (28) lie against one another only in certain regions, and in that the respective outer molded block rows (28) are moved toward one another.

15. The method as claimed in claim 14, characterized in that the molded block rows (28) are pressed against one another transversely with respect to the longitudinal extent of said rows.

16. The method as claimed in claim 15, characterized in that the molded block rows (28) are arranged approximately parallel in such a way that they lie against one another in the region of at least some predetermined breaking points (30).

17. The method as claimed in claim 15, characterized in that the molded block rows (28) are arranged approximately parallel in such a way that they lie against one another in the region of every second predetermined breaking point.

18. The method as claimed in claim 1, characterized in that a plurality of molded block rows (28) are produced in a mold (37), the molded block rows (28) resting on a support board (21) after the at least partial setting of said rows and being pressed laterally against one another on removal from the support board (21).

19. The method as claimed in claim 1, characterized in that, in order to sever the predetermined breaking points (30) between the molded blocks (10) of the molded block rows (28), a plurality of molded block rows (28) are arranged next to one another in such a way that the molded block rows (28) lie against one another only in the region of the predetermined breaking points (30), and in that the respective outer molded block rows (28) are moved toward one another.

20. A device, in particular mold (37), for the production of molded blocks (10), comprising a mold frame (20), which rests on a support board (21) and which has, at the bottom and top, open mold cavities (22) which are delimited by mold walls (23) of the mold frame (20), a plurality of mold cavities (22) being arranged in at least one row, characterized in that adjacent mold cavities (22) of a row are connected to one another, such that the molded blocks (10) of a row which can be produced in the mold (37) are interconnected to form a molded block row (28), and in that the mold cavities (22) are arranged in such a way that axes (31) and side faces (13, 15) of the molded block (10) run in an at least partially deviating manner from a longitudinal axis (32) of the respective molded block row (28) in the longitudinal direction of the respective molded block row (28).

21. The device as claimed in claim 20, characterized in that axes (31) of adjacent molded blocks (10) run in different directions in relation to the longitudinal axis (32) of the respective molded block row (28).

22. The device as claimed in claim 21, characterized in that an angle (33) between the axes (31) of adjacent molded blocks (10) of a molded block row (28) is between 179° and 140°.

23. The device as claimed in claim 22, characterized in that the axes (31) of every second molded block (10) of a molded block row (28) are aligned in concordance with one another and the axes (31) of the remaining molded blocks (10) of the molded block row (28) have a different course.

24. The device as claimed in claim 22, characterized in that the axes (31) of every second molded block (10) of a molded block row (28) are aligned in concordance with one another and the axes (31) of the remaining molded blocks (10) of the molded block row (28) have a mutually identical course.

25. The device as claimed in claim 21, characterized in that the axes (31) of every second molded block (10) of a molded block row (28) are aligned in concordance with one another and the axes (31) of the remaining molded blocks (10) of the molded block row (28) have a different course.

26. The device as claimed in claim 21, characterized in that an angle (33) between the axes (31) of adjacent molded blocks (10) of a molded block row (28) is between 179° and 170°.

27. The device as claimed in claim 21, characterized in that an angle (33) between the axes (31) of adjacent molded blocks (10) of a molded block row (28) is about 177°.

28. The device as claimed in claim 21, characterized in that the axes (31) of every second molded block (10) of a molded block row (28) are aligned in concordance with one another and the axes (31) of the remaining molded blocks (10) of the molded block row (28) have a mutually identical course.

29. The device as claimed in claim 20, characterized in that the axes (31) of every second molded block (10) of a molded block row (28) are aligned in concordance with one another and the axes (31) of the remaining molded blocks (10) of the molded block row (28) have a different course.

30. A molded block row (28) as claimed in claim 23, comprising at least four upright side walls (12, 13, 14, 15) and substantially horizontally oriented top surface (16) and bottom surface (17), the molded block row (28) being formed from a plurality of molded blocks (10) and adjacent molded blocks (10) of a molded block row (28) being connected to one another in the region of predetermined breaking points (30), characterized in that axes (31) and side faces (13, 15) of at least some adjacent molded blocks (10) deviate at least partially from a longitudinal axis (32) of the respective molded block row (28) in the longitudinal direction of the respective molded block (28).

31. The molded block row (28) as claimed in claim 30, characterized in that axes (31) and side faces (13, 15) of adjacent molded blocks (10) run slightly obliquely in relation to the longitudinal axis (32) of the respective molded block row (28).

32. The molded block row (28) as claimed in claim 31, characterized in that the predetermined breaking points (30) are arranged in the region of at least one exposed side of at least some molded blocks (10).

33. The molded block row (28) as claimed in claim 32, characterized in that each molded block row (28) has at least two molded blocks (10).

34. The molded block row (28) as claimed in claim 33, characterized in that a molded block of shorter length is arranged at at least one free end of a molded block row (28).

35. The molded block row (28) as claimed in claim 33, characterized in that an end block (36), is arranged at at least one free end of a molded block row (28).

36. The molded block row (28) as claimed in claim 32, characterized in that a molded block of shorter length is arranged at at least one free end of a molded block row (28).

37. The molded block row (28) as claimed in claim 32, characterized in that an end block (36) is arranged at at least one free end of a molded block row (28).

38. The molded block row (28) as claimed in claim 31, characterized in that each molded block row (28) has at least two molded blocks (10).

39. The molded block row (28) as claimed in claim 31, characterized in that a molded block of shorter length is arranged at at least one free end of a molded block row (28).

40. The molded block row (28) as claimed in claim 31, characterized in that an end block (36) is arranged at at least one free end of a molded block row (28).

41. The molded block row (28) as claimed in claim 30, characterized in that the predetermined breaking points (30) are arranged in the region of at least one exposed side of at least some molded blocks (10).

42. The molded block row (28) as claimed in claim 30, characterized in that each molded block row (28) has at least two molded blocks (10).

43. The molded block row (28) as claimed in claim 30, characterized in that a molded block of shorter length is arranged at at least one free end of a molded block row (28).

* * * * *